United States Patent [19]

Simonson et al.

[11] Patent Number: 4,892,618

[45] Date of Patent: Jan. 9, 1990

[54] METHOD FOR THE MANUFACTURE OF PRODUCTS CONTAINING WOOD CHIPS BY INSOLUBILIZING THE LIGNIN

[76] Inventors: Rune Simonson, Sotenäsvägen 64, S-433 64 Partille; Brita Ohlsson, N. Stommen 318, S-438 00 Landvetter, both of Sweden

[21] Appl. No.: 147,049

[22] Filed: Jan. 22, 1988

Related U.S. Application Data

[63] Continuation of Ser. No. 848,207, Apr. 4, 1986, abandoned.

[30] Foreign Application Priority Data

Apr. 4, 1985 [SE] Sweden ..... 8501688

[51] Int. Cl.[4] ..... B27N 3/04; B27N 1/02; D21J 1/04

[52] U.S. Cl. ..... 162/16; 156/62.4; 156/326

[58] Field of Search ..... 264/109; 162/16, 161, 162/13, 180, 160; 156/62.2, 62.4, 326; 530/500

[56] References Cited

U.S. PATENT DOCUMENTS

| | | | |
|---|---|---|---|
| 3,895,996 | 7/1975 | Lange et al. | 162/16 |
| 3,918,981 | 11/1975 | Long | 162/160 |
| 3,937,647 | 2/1976 | Backstrom et al. | 162/16 |
| 4,116,761 | 9/1978 | Head | 162/152 |
| 4,265,846 | 5/1981 | Shen | 264/109 |
| 4,359,507 | 11/1982 | Gaul et al. | 156/326 |
| 4,486,557 | 12/1984 | Gaul et al. | 264/109 |

*Primary Examiner*—Steve Alvo

[57] ABSTRACT

A method for the manufacture of products containing compressed and adhesive-bonded wood chippings, preferably of different sizes. Before the chippings are combined together by glueing to form a product of high dimensional stability, they are impregnated with lignin in conjunction with water and at a pH which essentially does not exceed 12.5. Once the lignin has been absorbed by the wood chippings it is fixed against leaching by the water by the modification of same into an essentially water-insoluble form by impregnating the chips with a weakly acid aqueous solution of a metal salt.

8 Claims, No Drawings

METHOD FOR THE MANUFACTURE OF PRODUCTS CONTAINING WOOD CHIPS BY INSOLUBILIZING THE LIGNIN

This application is a continuation of application Ser. No. 848,207, filed Apr. 4, 1986, now abandoned.

The present invention relates to a method for the manufacture of products containing compressed and adhesive-bonded wood flakes or chippings preferably of different sizes.

Products based on wood chippings which have been bonded together to form a comparatively homogeneous body by means of an adhesive, usually a hot-setting glue, have gained considerable popularity in the building industry. The predominant product is sheets of this material, known as chipboard, although the manufacture of more complicated products such as mouldings and boxes also takes place. It has been found difficult to execute these wood chip products in such a way that they can be used in the presence of moisture. Chipboard and other products are accordingly used to all intents and purposes exclusively indoors in dry environments. Their sensitivity to moisture can be attributed on the one hand to the adhesive, and on the other hand to the wood chip material. However, it has now proved possible to produce a water-resistant adhesive at a price which is acceptable in this context. The factor which obstructs the manufacture of moisture-resistant wood chip products is thus primarily the moisture absorption properties of the wood chip, as well as the dimensional changes associated with this and the tendency towards cracking and disintegration on repeated wetting and drying. Another significant factor is the tendency to rotting of the wood chip.

The object of the present invention is to make available a method for the impregnation of wood chip material intended for the manufacture of wood chip products, which produces a dimension-stabilizing effect and thus a reduction in cracking, as well as resistance to rotting.

The object of the invention is achieved by executing the method, which is defined in that the chippings, before they are combined together by glueing to form a product of high dimensional stability, are impregnated with lignin in conjunction with water and at a pH which essentially does not exceed 12.5, and wherein said lignin, once it has been absorbed by the wood chippings, is fixed against leaching by the water by the modification of same into an essentially water-insoluble form.

The substance used for impregnation in the method in accordance with the invention contains as its active ingredient essentially lignin, appropriately derived from the sulphate method for the manufacture of paper pulp, i.e. so-called waste liquor lignin. Such lignin is known to be produced in large amounts in the course of the manufacture of paper pulp in accordance with this chemical method. This lignin is available in large quantities and at a price which makes it attractive in this context.

In order for the lignin to be capable of being absorbed by the pulp wood in this process, it must be present in the form of an aqueous solution or an aqueous dispersion. Its liquid form thus renders it suitable for use in the established methods, in which the pulp wood is placed inside a pressure chamber and is injected with the impregnation substance through excess pressure. It is, of course, appropriate to use water in this case for reasons of cost, and it will probably not, furthermore, suggest any alternatives and will combine with the moisture already present in the pulp wood.

The lignin, which is only water-soluble to a limited extent in the form in which it is received, but is soluble in an alkaline solution, can be transformed into a fully water-soluble form, for instance by carboxy methylation. The most suitable starting material in this case is sulphate lignin which has been precipitated by the addition of an acid at pH 9, for example, from the industrial effluent from the sulphate boiling process. The sulphate lignin is caused to react in an aqueous solution (for 10 h at 90° C.) with NaOH and monochloroacetic acid in the mol ratio of 1:2:1, where the mole weight for a C9 unit the lignin is set at 200. The carboxy methylated lignin is precipitated with acid at a pH of about 2 and is isolated by centrifuging. The lignin can be purified by subsequently dissolving it in acetic acid and precipitating it out once more.

The impregnation with lignin by this method is best performed by a previously disclosed process. The wood chip which is to be impregnated is placed inside a chamber which is then sealed. The wood chip is then subjected to a vacuum so that a large proportion of the air contained in its pores is removed. The lignin is then injected with water. As has already been mentioned, the lignin is water-soluble only to a limited extent without special treatment such as by carboxy-alkylation of the lignin or by using carboxy-methylated alkali lignin, each in about 15% solution, although it can then be injected in a soluble form by making the impregnation solution alkaline, with a pH essentially of less than 12.5. The impregnation fluid penetrates into the pulp wood in such a way as to bring about its impregnation. The pulp wood together with the fluid can be placed under pressure, thereby improving the penetration. The type of pulp wood which lends itself to this process is primarily pine pulp, although it appears that other conifer pulp and even hardwood pulp can be used. This stage in the process and the appropriate data may be appreciated from the accompanying examples; see in particular Example 1.

A large proportion of the water will drain away after impregnation, and the impregnation substance, the lignin, will remain. This is susceptible to leaching out, however, in its at least partially water-soluble form, and in this state the material would not be suitable for use in those applications in which it is primarily wished to use it, i.e. out of doors. It is accordingly necessary to fix the lignin by transformation it into a water-insoluble form. This can be achieved by treating the wood in a second impregnation stage with an aqueous solution of aluminium sulphate, copper sulphate or a mixture of aluminium sulphate and copper sulphate. Fixing takes place under pressure, as may be appreciated from the examples. Even when used in small amounts copper will provide additional protection against rotting. The combination of lignin and copper affords excellent resistance to white rot and to brown rot, and also to soft rot and tunnelling bacteria from non-sterile soil.

Before the lignin is fixed, any surplus impregnation fluid can be washed off the surface of the wood chip with water. It is, in fact, desirable for the pulp wood and the adhesive to be brought into intimate contact during the glueing operation to form the wood chip product.

An important observation in conjunction with the invention is that an aqueous solution of lignin should not be excessively alkaline (pH max. 12.5), which makes it easier to achieve a good result. By avoiding the use of an excessively alkaline solution, the inherent resistance to rot of the pulp wood itself will be affected to a lesser degree. On the other hand the action of an alkali on the pulp wood will cause a certain amount of swelling of the wood and thus improved penetration of the lignin into the cell wall. This has the effect of producing an improved impregnation effect. It is accordingly important to adjust the pH value so that a good impregnation effect is achieved in return for a reasonable decrease in the natural resistance to rot of the pulp wood. The optimum pH value lies in the range from 6 to 11. The decrease in the resistance to rot which is obtained as a result of the use of alkaline solutions can be off-set by the addition of copper, as will be appreciated from the following.

The fixing solution is provided in an appropriate form by a weakly acidic solution, which improves the fixing effect by facilitating the chemical process which transforms the lignin into its water-insoluble form. A relatively large quantity of metal ions is required for this process, and the quantity increases in line with the increase in the quantity of lignin used in the impregnation. At the commonly used lignin concentration the quantity of metal ions will be greater than that provided by the copper which is required for the aforementioned additional protection against rotting. Since the price of copper is higher than the price of aluminium, it is accordingly advisable for the fixing solution to be based partly on a copper salt in the amount necessary for the aforementioned additional protection against rotting, with the rest being based on an aluminium salt to provide the necessary fixing. Zinc may be used instead of copper. The aforementioned additional protection against rotting requires the pulp wood to contain an amount of copper, which may be limited to 1% calculated on the quantity of dry wood, in relation to the type of wood and the quantity of lignin added. The smallest quantity of copper necessary to provide good additional protection against rotting, i.e the so-called threshold value, will vary with the type of wood. It is generally true to state, however, that hardwoods as a rule require about twice the quantity required for conifers such as pine, for instance.

It must be pointed out that the wood chippings will, as a general rule, have undergone a certain degree of disintegration of the pulp wood in the course of the chip separation operation. Favourable penetration conditions may be expected, therefore. In many cases it is possible in this way to avoid the need for special measures, such as complete solubility in water, in order to increase penetration. It is also possible to perform the fixing operation by heat treatment, when separation of the acetyl groups in the pulp wood and a chemical reaction between the wood material and the lignin substance, preferably in the form of an ammonium salt, will assist in the transformation of the lignin into water-insoluble form. The temperature of the heat treatment process shall be at least 80° C., and preferably 110° C., in order for a good reaction to take place.

EXAMPLE 1

Industrial wood chippings intended for the manufacture of chipboard were impregnated with different amounts of alkali lignin. The alkali lignin was recovered from the effluent from the conventional sulphate boiling process by acidification to pH 9, by separation of the precipitated lignin by filtration, and by drying of the lignin precipitate. Impregnation solutions were prepared with different contents of alkali lignin by mixing together alkali lignin, water and a solution of sodium hydroxide to the desired pH. The impregnation solution was filtered before use.

The wood chip was impregnated with alkali lignin by the conventional vacuum pressure method. The wood chip was allowed to drain after impregnation, and in certain cases any impregnation solution remaining at the surface was washed off with water for about 15 seconds, whereupon the wood chip was allowed to dry in the air.

Fixing of the impregnated lignin then took place by impregnation with a solution of an acidic metal salt such as aluminium sulphate, aluminium chloride or an aluminium complex salt. In order further to improve the rot protection effect of the treatment, fixing was occasionally also performed with the addition of a copper salt to the fixing solution. The wood chip was finally dried at 100° C. to a moisture content of only a few percent in accordance with customary procedure. Specimen sheets (35×35×1 cm) were produced in a laboratory press in which the pressed sheets were heated to about 190° C. A moulding pressure of 240 kp/cm$^2$ was applied for the first 40 seconds, followed by 110 kp/cm$^2$ for a further 35 seconds, and finally by 50 kp/cm$^2$. Pressing continued for a total period of 2 minutes.

A conventional chipboard adhesive of the melamine-urea-formaldehyde type intended for use in the manufacture of sheets for outdoor use was used for glueing together the wood chip. The proportion of adhesive was 8%, calculated in relation to the dry wood chip.

The dimensional variation in the specimen sheets (measured as the swelling of the thickness as a percentage of the original thickness) when treated with water was tested on the one hand by determining the swelling of the thickness in relation to the elapsed time (leaching test; Table 1), and on the other hand by measuring the swelling resulting from repeated leaching with water at 20° C. followed by drying at 105° C. (Table 2). The repeated drying involved in the latter method of testing makes this an exceptionally severe test of the dimensional stability of the material. The specimen sheets listed in Table 1 and Table 2 were produced from wood chip which had been treated as follows:

Test 1:

Impregnation with a 10% aqueous solution of alkali lignin at pH 11. Fixing with a 5% solution of aluminium sulphate.

Test 2:

Impregnation with a 5% aqueous solution of alkali lignin at pH 12. Fixing with a 5% solution of aluminium sulphate.

Test 3:

Impregnation with a 15% solution of alkali lignin at pH 12. Fixing with a 3.9% solution of aluminium chloride.

A control sheet was produced from untreated wood chip with an adhesive proportion of 8%.

EXAMPLE 2

Sample sheets produced by the method indicated in Example 1 were also manufactured from wood chip which had been impregnated with alkali lignin derived by carboxy alkylation.

Tables 1 and 2 contain the results of the swelling test for a sample sheet produced from wood chip treated as follows:

Test 4:

Impregnation with a 15% aqueous solution of carboxy methylated alkali lignin at pH 9. Fixing with a 3.9% solution of aluminium chloride.

EXAMPLE 3

Pine pulp wood was impregnated at 50° C. with an aqueous solution of carboxy methylated sulphate lignin (pH 7). Vacuum-pressure impregnation was used for a period under vacuum of 30 minutes, followed by a period under pressure of 90 minutes at 1 MPa. After impregnation the pulp wood material was found to have increased in weight by about 2.5 times its original dry weight. Drying to a (certain) absorbent state was then performed so that the fixing solution could penetrate (avoiding time-consuming diffusion). After drying and weighing the proportion of lignin absorbed was determined at about 15 percent by weight calculated on the basis of the dry wood.

In order to obtain the impregnated lignin in a water-insoluble and non-leachable form, the lignin was fixed by treating the wood material in a second stage of impregnation with an aqueous solution of aluminium sulphate, copper sulphate or a mixture of aluminium sulphate and copper sulphate. The fixing was performed at 20° C., and the length of the period under pressure was 60 minutes at about 1 MPa.

Both the untreated and the treated wood was tested with regard to its resistance to white rot, brown trot, soft rot and tunnelling bacteria (non-sterile soil). The results of this rotting test are presented in Table 3. Test 1, conducted without fixing the lignin, showed a weight loss when leached with water equivalent to the leaching out of about 90% of the impregnated lignin. This treatment is inadequate, therefore, if the wood material is to be used out of doors and is to be exposed to moisture. Fixing with aluminium sulphate and/or copper sulphate resulted in a level of leaching out of the lignin in water which was less than 1% of the quantity of modified lignin supplied.

As may be appreciated from Table 3, impregnation and fixing with aluminium sulphate alone (Test 2) produces good resistance to white rot and brown rot, although attack primarily by soft rot (non-sterile soil) was relatively high. The addition of small quantities of copper (0.3–0.4%) produced very good resistance to rotting (Tests 3 and 4), presumably due to the synergistic effect of the impregnation and the fixing.

EXAMPLE 4

Pine pulp wood is impregnated in accordance with the method indicated in Example 3 with lignin solutions of various concentrations so as to produce the lignin contents in the wood indicated in Table 4. Fixing was performed with a solution of aluminium salt and copper salt, or simply of copper salt, so that the indicated copper contents were achieved. The results of the brown rot test are to be found in Table 4.

These examples relate to experimental production on a laboratory scale. It is, however, possible for an expert to adapt this to a production scale.

TABLE 1

Percentage swelling of the thickness of specimen sheets of chipboard impregnated with alkali lignin when leached with water, in relation to the leaching period.

| | Percentage swelling of thickness[1] after | | | | | | | | |
|---|---|---|---|---|---|---|---|---|---|
| Sample | 0 min | 10 min | 30 min | 1 hour | 3 hours | 6 hours | 1 day | 10 days | 25 days |
| Reference | 0 | 11 | 25 | 38 | 43 | 46 | 49 | 53 | 54 |
| 1 | 0 | 1 | 2 | 3 | 4 | 5 | 10 | 17 | 18 |
| 2 | 0 | 1 | 2 | 4 | 6 | 9 | 13 | 15 | 16 |
| 3 | 0 | 0.5 | 1 | 2 | 3 | 4 | 8 | 8 | 9 |
| 4 | 0 | 1 | 2 | 3 | 4 | 6 | 8 | 9 | 9 |

[1]Swelling of thickness, calculated as a percentage of the original thickness in the dry state.

TABLE 2

Percentage swelling of the thickness of specimen sheets of chipboard impregnated with alkali lignin when repeatedly leached with water and dried[2].

| | Percentage swelling of thickness[1] | | | | | | | | | | | | |
|---|---|---|---|---|---|---|---|---|---|---|---|---|---|
| Sample | T[3] | V[3] | T | V | T | V | T | V | T | V | T | V | T |
| Reference | 0 | 52 | 43 | 66 | 48 | 71 | 52 | 75 | 55 | 77 | 58 | 85 | 62 |
| 1 | 0 | 18 | 10 | 18 | 11 | 17 | 10 | 16 | 10 | 16 | 10 | 16 | 10 |
| 2 | 0 | 19 | 10 | 22 | 12 | 23 | 14 | 23 | 13 | 23 | 13 | 22 | 13 |
| 3 | 0 | 9 | 4 | 9 | 4 | 9 | 4 | 9 | 4 | 10 | 4 | 9 | 4 |
| 4 | 0 | 9 | 3 | 8 | 3 | 7 | 3 | 8 | 3 | 8 | 3 | 8 | 3 |

[1]Change in thickness, calculated as a percentage of the original thickness in the dry state.
[2]Each test cycle consisted of leaching with water (at 20° C.) for 5 days, followed by drying for 1 day at 105° C.
[3]T = dry state; V = wet state.

TABLE 3

| | | | Weight loss in rotting test, %[1] | | Attack in non-sterile |
|---|---|---|---|---|---|
| Sample | Modified lignin, % | fixing with | White rot | Brown rot | soil after 3 months[2] |
| Reference | — | — | 20.4 | 63.4 | ~5 |
| 1 | 15 | — | 20.7 | 15.4 | ~4 |
| 2 | 15 | $Al_2(SO_4)_3$ | 7.3 | 10.5 | ~3 |
| 3 | 15 | $CuSo_4$ | 6.2 | 5.4 | 0[3] |
| 4 | 15 | $Al_2(SO_4)_3$ + $CuSO_4$ | 6.1 | 6.1 | 0[3] |

[1]Exposure for 3 months to white rot (*Phlebiopsis gigantea*) and to brown rot (*Fomitopsis pinicola*).
[2]Evaluated on a five-point scale, on which 5 represents severe attack and 0 represents absence of attack.
[3]No attack was observed on these specimens, even after exposure for 15 months. Cu content was 0.3–0.4 percent by weight.

TABLE 4

| | | | Weight loss in brown rot test | | |
|---|---|---|---|---|---|
| Sample | Modified lignin, % | Copper content, % | Sample, % | Untreated reference, % | weight loss ratio, sample/reference |
| 1 | 20 | 1.0 | 1.7 | 65.0 | 0.03 |
| 2 | 20 | 0.55 | 2.3 | 61.0 | 0.04 |
| 3[1] | 20 | 0.39 | 4.4 | 51.6 | 0.08 |
| 4 | 10 | 0.82 | 1.9 | 63.5 | 0.03 |
| 5 | 10 | 0.68 | 15.8 | 62.3 | 0.25 |
| 6[1] | 5 | 0.73 | 2.4 | 63.8 | 0.04 |
| 7 | 5 | 0.56 | 9.9 | 47.4 | 0.21 |
| 8[1] | 2.5 | 0.44 | 7.9 | 46.2 | 0.17 |

TABLE 4-continued

| Sample | Modified lignin, % | Copper content, % | Weight loss in brown rot test: Sample, % | Weight loss in brown rot test: Untreated reference, % | weight loss ratio, sample/reference |
|---|---|---|---|---|---|
| 9 | 2.5 | 0.33 | 10.2 | 57.3 | 0.18 |

[1]pH 7 for the impregnation solution. Others pH 9.

We claim:

1. A method for the manufacture of moisture resistant products from wood chips by compression and adhesive bonding comprising the steps of (a) transforming lignin into water-soluble form by dissolving lignin and water-soluble derivatives thereof in an aqueous solution of pH 12.5 or less;

(b) impregnating the wood chips and the cells of the wood chips with said aqueous lignin solution (c) treating the chips impregnated with said water-soluble lignin so it will not leach from said wood chips, by insolubilizing the lignin within the wood chips by impregnating the chips with a weakly acid aqueous solution of a metal salt in a further impregnating step;

(d) drying said chips containing insolubilized lignin;

(e) coating the outer surfaces of the wood chips impregnated with the insolubilized lignin with glue;

(f) and then compressing the coated chips to form said product.

2. The method according to claim 1, wherein insolubilizing of lignin within the chips is performed with at least one salt of a lignin-insolubilizing ion selected from the group consisting of aluminum, zinc and copper salts and mixtures of such salts.

3. The method according to claim 2, wherein said salt is an insolubilizing amount of an aluminum salt.

4. The method according to claim 3, wherein a portion of said salt further contains up to 1% by dry weight of said wood chips of a lignin-insolubilizing and rot-preventing copper salt.

5. The method according to claim 2, wherein said salt is an insolubilizing amount of a copper salt.

6. The method according to claim 1, wherein the water-soluble lignin for the initial impregnation is a carboxylated lignin.

7. The method according to claim 1, wherein said water-soluble lignin for impregnation is a carboxyalkylated lignin.

8. The method according to claim 1, wherein said water-soluble lignin is a sulfonated lignin.

* * * * *